United States Patent [19]

Alexander

[11] Patent Number: 4,900,089

[45] **Date of Patent: * Feb. 13, 1990**

[54] HEADREST

[76] Inventor: Daniel R. Alexander, 7493 Cedar Knolls Dr., Warrenton, Va. 22186

[ * ] Notice: The portion of the term of this patent subsequent to Feb. 28, 2006 has been disclaimed.

[21] Appl. No.: 315,482

[22] Filed: Feb. 27, 1989

Related U.S. Application Data

[63] Continuation-in-part of Ser. No. 118,954, Nov. 10, 1987, Pat. No. 4,807,933.

[51] Int. Cl.[4] ..... A47C 7/36

[52] U.S. Cl. ..... 297/391; 297/397; 297/410

[58] Field of Search ..... 297/391, 395, 397, 396, 297/230, 410; 5/436, 437

[56] References Cited

U.S. PATENT DOCUMENTS

| | | | |
|---|---|---|---|
| D 188,416 | 7/1960 | Ram | 297/397 |
| 3,017,221 | 1/1962 | Emery | 297/397 |
| 3,325,214 | 6/1967 | McQueeney | 297/391 |
| 3,366,417 | 1/1968 | Belk | 297/397 |
| 4,440,443 | 4/1984 | Nordskog | 297/397 |
| 4,607,886 | 8/1986 | Mazhar | 297/395 |
| 4,807,933 | 2/1989 | Alexander | 297/391 |

FOREIGN PATENT DOCUMENTS

| | | | |
|---|---|---|---|
| 3418253 | 11/1985 | Fed. Rep. of Germany | 297/397 |
| 91685 | 6/1968 | France | 297/391 |
| 893519 | 4/1962 | United Kingdom | 297/230 |

*Primary Examiner*—Francis K. Zugel

[57] ABSTRACT

An improved aftermarket headrest which is maintained in an operative position without the aid of screws, bolts, clips and/or mounting brackets and without any modification of a vehicle seat or body. The headrest includes a unitary resilient body having an upper head supporting part, a lower placement maintaining part, a substantially horizontal and planar face separating the upper and lower parts, and a substantially vertical and planar back surface. The headrest is placed and maintained in an operative position by squeezing the lower part of the headrest between an upper portion of a seat-back and an adjacent portion of a vehicle body.

10 Claims, 4 Drawing Sheets

HEADREST

CROSS-REFERENCE TO RELATED APPLICATIONS

This application is a continuation-in-part of copending, allowed application Ser. No. 118,954, filed Nov. 10, 1987 and which is to issue as U.S. Pat. No. 4,807,933 on Feb. 28, 1989.

BACKGROUND OF THE INVENTION

The present invention is directed to a headrest, and more particularly concerns a headrest which is maintained in an operative position without the aid of screws, bolts, clips and/or mounting brackets.

In certain vehicles, such as trucks and vans, an upper portion of the seat-back of either a bucket or bench style seat may be located within a few inches of a rear window. Since most of these vehicles do not come standard with headrests, a safety hazard exists because if the vehicle were to be rearended by another vehicle it is possible for a head of the driver and/or a passenger to fly back and hit the rear window.

Commercially available aftermarket headrests require modification of either the vehicle seat or body and the use of screws, bolts and/or brackets to attach the headrest. Such modifications are undesirable because of the associated labor expense and undesirable cutting or drilling of the seat or vehicle. When these headrests are removed, undesirable holes and marks are left on either the seat, body or both.

Hence, there is a need for a relatively inexpensive, easily attached and detached, aftermarket headrest which can be maintained in an operative position without requiring the use of fastener elements, brackets or the modification of the seat or vehicle body.

SUMMARY OF THE INVENTION

In accordance with the present invention, a headrest is provided which is placed and maintained in an operative position by squeezing a lower portion of the headrest between an upper portion of a seat-back and an adjacent portion of a vehicle surface.

The principal object of the present invention is the provision of an aftermarket headrest which is relatively inexpensive, easy to install and remove, and does not require the use of fastener elements, brackets, clips or the modification of the seat or vehicle body.

Another object of the present invention is the provision of a headrest which can be used with any seat, chair, bench, headboard, etc. which is located within inches of a wall, window, vehicle body or the like.

A still further object of the present invention is the provision of a headrest which may be made from a variety of resilient materials and which may be covered with upholstery material matching the color and/or upholstery of the seat with which it is used.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
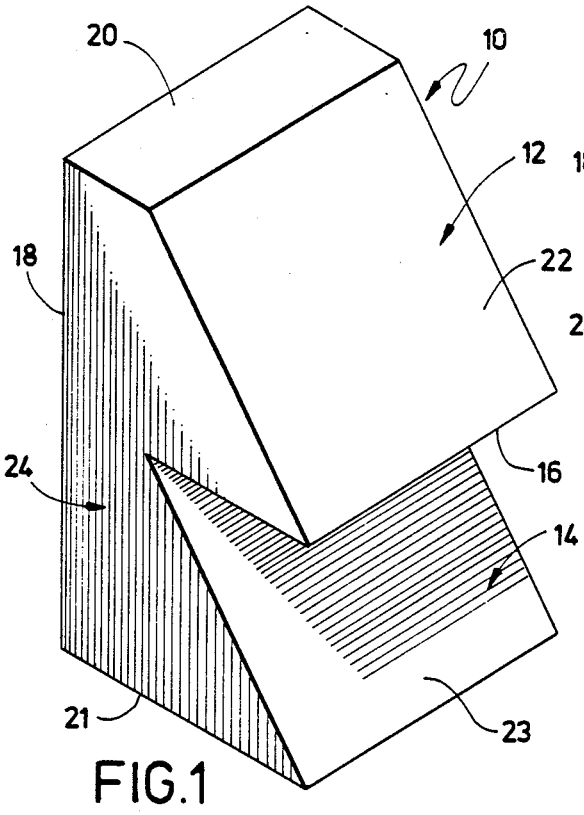
FIG. 1 is an isometric illustration of a headrest in accordance with one embodiment of the present invention.
Figure 2:
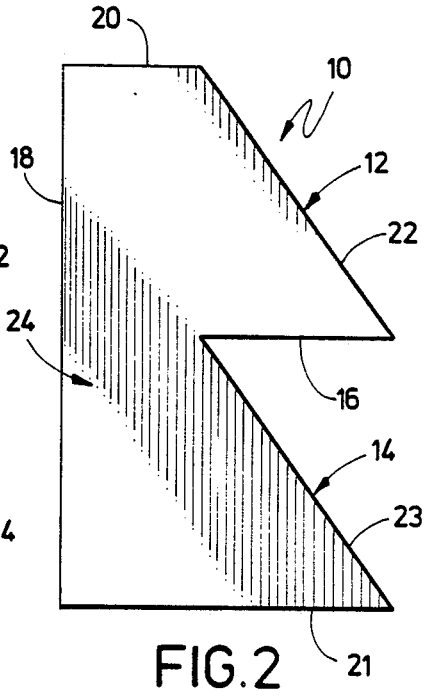
FIG. 2 is a side view of the headrest of FIG. 1.

In accordance with a preferred embodiment of the present invention as shown in FIGS. 1 and 2, a headrest 10 includes an upper head supporting part 12, a lower placement maintaining part 14, a substantially horizontal and planar support face 16 separating the upper and lower parts 12 and 14, and a substantially vertical and planar back face 18. The headrest further has substantially horizontal and planar top and bottom surfaces 20 and 21, respectively, a first slanted planar surface 22 which in use contacts the back of a user's head, and a second slanted planar surface 23 which in use contacts the back of the upper portion of a seat.

Figure 3:
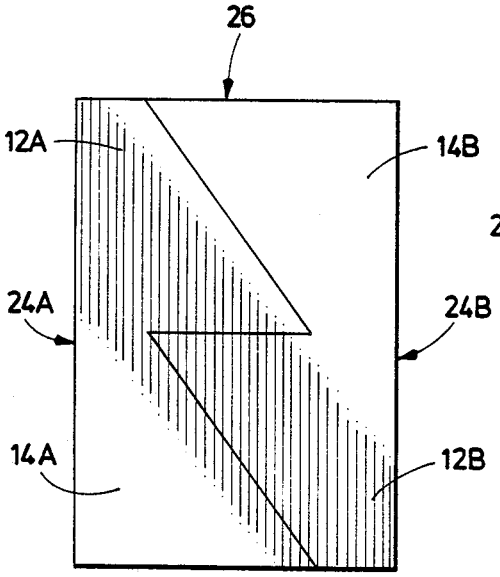
FIG. 3 is an exemplary representation of the production of two like headrests from a rectangular block of resilient material.

The upper and lower parts 12 and 14 together form a unitary resilient body 24 which may be formed, for example, of foam rubber. As shown in FIG. 3, a pair of like headrest bodies 24A and 24B may be cut from a single rectangular block of foam rubber 26. The body 24A has an upper part 12A and a lower part 14A, while the body 24B has an upper head supporting part 12B and a lower placement maintaining part 14B. In use, the body 24B would be inverted.

Figure 4:
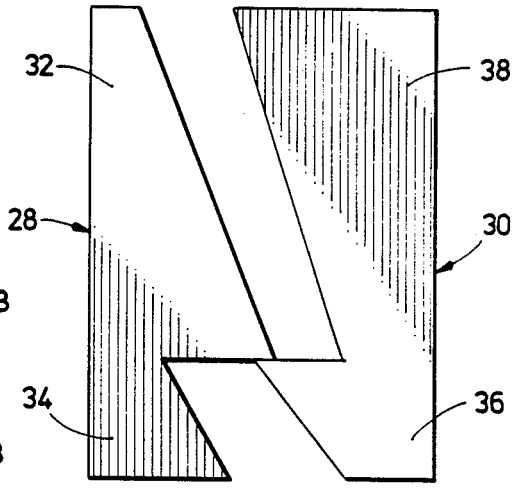
FIG. 4 is an illustration of two differently proportioned headrests made from the same rectangular block of starting material.

As shown in FIG. 4, two resilient headrest bodies 28 and 30 having different dimensions may be cut from a single block of material without waste. The body 28 has an upper part 32 and a lower part 34 which is shorter than the upper part 32. The body 30 has a head supporting part 36 and an elongated placement maintaining part 38. In use, the body 30 would be inverted and the elongated part 38 would accommodate vertical adjustment of the headrest.

Figure 5:
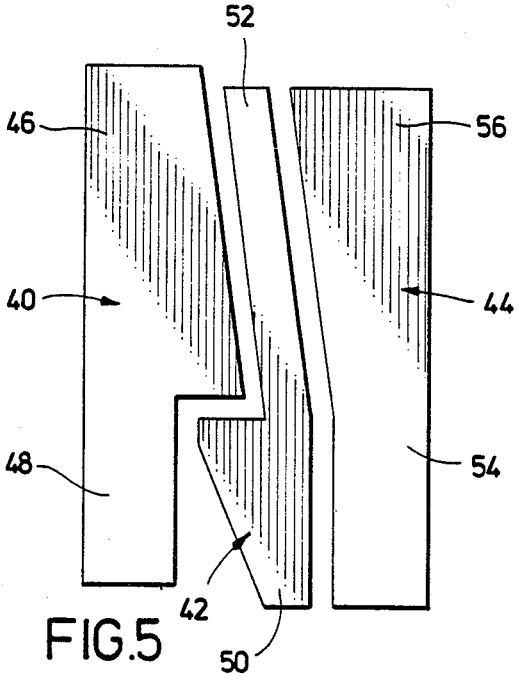
FIG. 5 is a side view of three different headrests made from a single block of material.

As illustrated in FIG. 5, three different headrest bodies 40, 42 and 44 may be cut from a single block of starting material with a minimal amount of waste. The body 40 includes an upper part 46 and a lower part 48. The body 42 has a head supporting part 50 and a placement maintaining part 52. The body 44 has a relatively thin end portion 54 and a relatively thick end portion 56. In use, the end portion 54 would usually serve as a head supporting part and the end portion 56 would be the placement maintaining part. However, a particular user may prefer to have the portion 56 serve as a head supporting part and the portion 54 be the placement maintaining part. Either way, headrest body 44 has a continuous form which facilitates vertical adjustment in headrest positioning.

It is contemplated that a headrest unitary body may be formed from a variety of resilient materials, i.e. foam rubber, sponge rubber, or the like. Such a foam body could be covered with an appropriately colored material or cloth matching the seat with which it is used or other colors pleasing to a user. A foam body can be formed by cutting as shown in FIGS. 3–5 or by molding or extrusion techniques known in the foam arts. For example, a continuous foam extrusion having a cross section as shown in FIG. 2 can be sliced transverse to its length to form individual headrest bodies. Further, the body could have rounded or curved edges as well as angled edges.

Also, a headrest body could be an air filled plastic, vinyl or rubber hollow article which could be filled by a user to a preferred head support pressure. Such an air filled body could be filled manually by the user or automatically by an aftermarket air compressor system similar to that used in modern power seats. It is contemplated that such an automatic headrest filling system could be a vital part of a complete crash safety system made up, for example, of seat belts, steering wheel and dash board air bags, and inflatable headrests.

Figure 6:
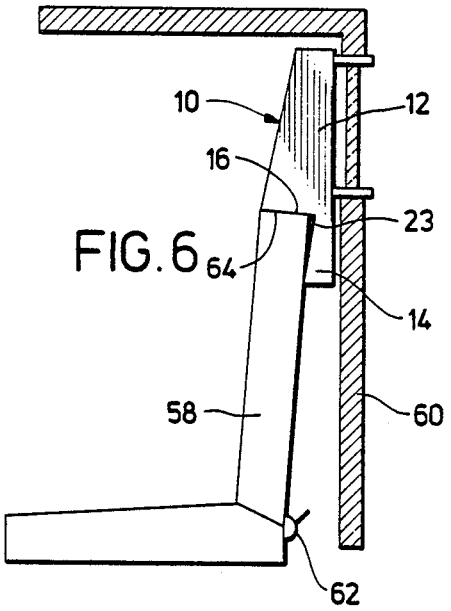
FIG. 6 is a partial cross section of an exemplary headrest in an operative position between a bench style seat and a rear window.

In operation and as shown in FIG. 6, a headrest 10 (FIG. 1) is clamped in an operative position with the lower part 14 squeezed between the seat 58 and vehicle body 60. A headrest can be placed in such an operative position by: (a) moving the seat to its most forward position; (b) releasing latch 62 and tilting the seat back forward; (c) placing one or more headrest faces 16 on seat top surface 64 with the surface or surfaces 23 against the back surface of the upper portion of the seat back; (d) tilt the seat back up till latch 62 locks; and, (e) then move the seat to the desired position.

The face 16 is designed to extend far enough and the body 24 is made from resilient enough material to accommodate forward and backward movement of the seat 58. In other words, if a user has short legs and moves the seat 58 as far forward as it will go, the face 16 will still touch the top seat surface 64 and not allow the headrest 10 to fall down behind the seat 58. Also, if a user has long legs and moves the seat 58 as far rearward as it will go, the lower part 14 is sufficiently resilient to accommodate this movement. An added advantage of the present headrest is that the lower part 14 absorbs the jolt usually experienced when a seat is moved to its most rearward position.

It is contemplated that one or more separate, for example 9–12 inch wide, headrests 10 are used to accommodate one or more users or that a single, for example 40 inch wide, headrest is used.

Figure 7:
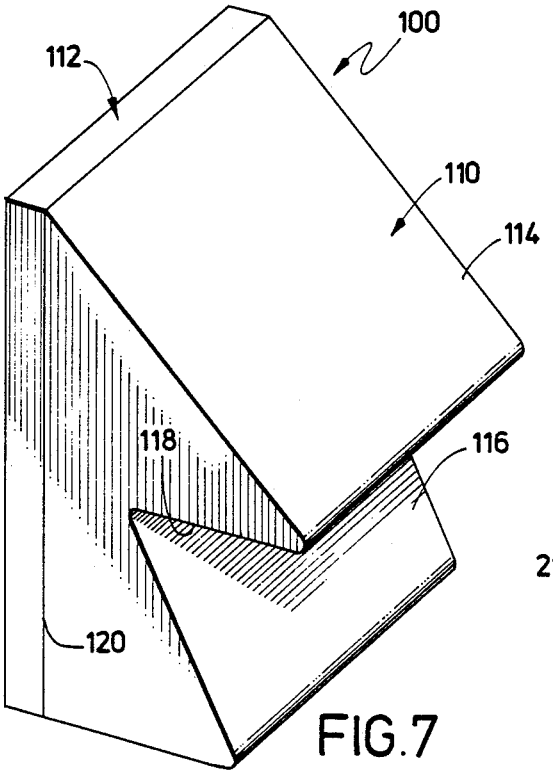
FIGS. 7, 8, 9, 10, 11, 13 and 14 are isometric illustrations of headrests in accordance with various embodiments of the present invention.

As shown in FIG. 7 of the drawings, a headrest 100 includes a foam body 110 and a blow cushioning, rectangular section 112. For example, the body 110 is made of foam rubber, while the section 112 is made of styrofoam. The foam body 110 includes a head supporting upper part 114, a lower placement maintaining part 116, a planar surface 118 therebetween, and a vertical back face 120. The body 110 and section 112 are joined by, for example, a suitable adhesive and covered with fabric, leather, fur, etc.

Figure 8:
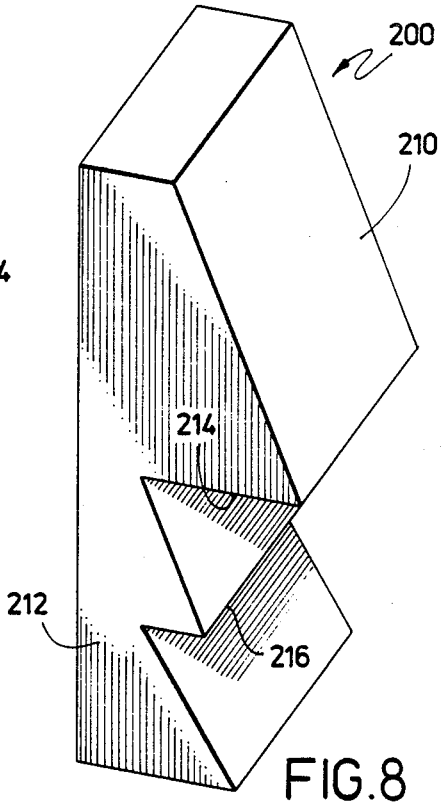
Figure 9:
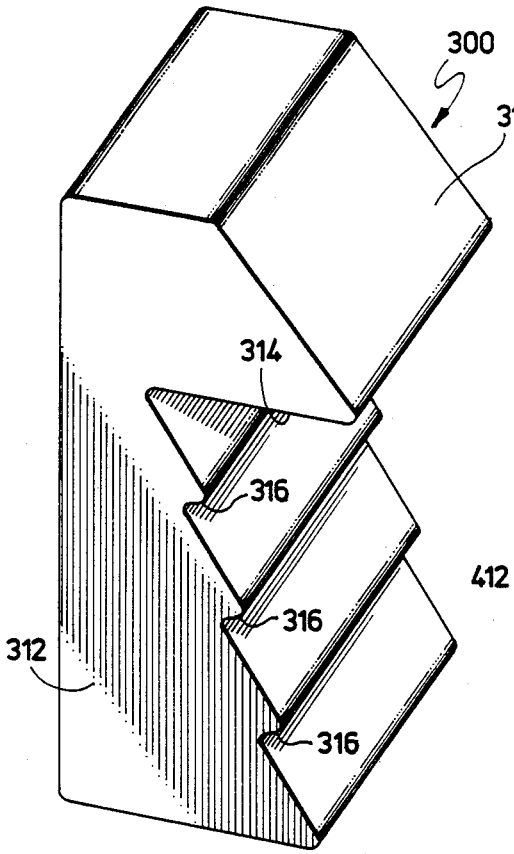
Figure 10:
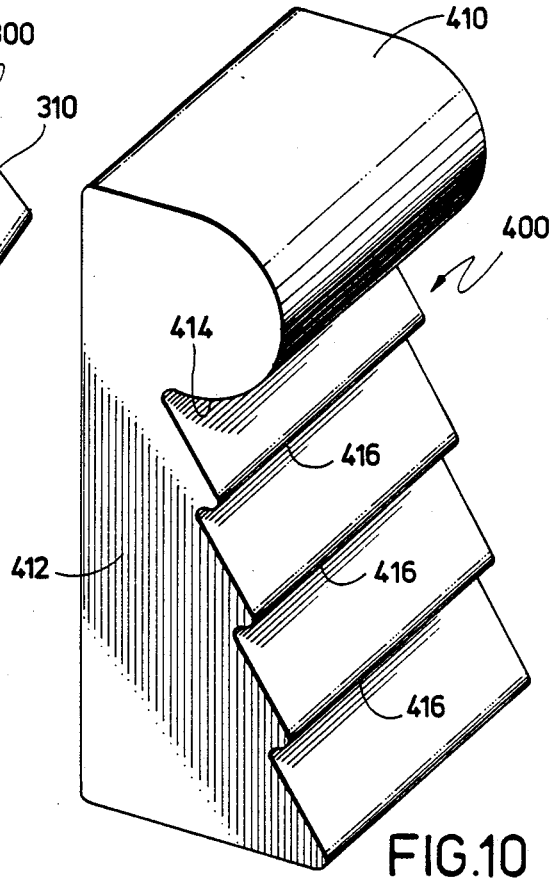

With reference to FIGS. 8, 9, and 10 of the drawings, headrests 200, 300, and 400, respectively, are adjustable in that each one includes a plurality of horizontal support surfaces. The headrest 200 includes an upper head supporting formation 210, a lower placement maintaining formation 212, and major and minor horizontal support surfaces 214 and 216. Similarly, the headrest 300 includes an upper head supporting formation 310, a lower placement maintaining formation 312, and major and minor horizontal support surfaces 314 and 316. Likewise, the headrest 400 includes an upper head supporting formation 410, a lower placement maintaining formation 412, and major and minor horizontal support surfaces 414 and 416. The minor support surfaces accommodate vertical adjustment of the headrest to suit the particular height and/or comfort of the user.

Figure 11:
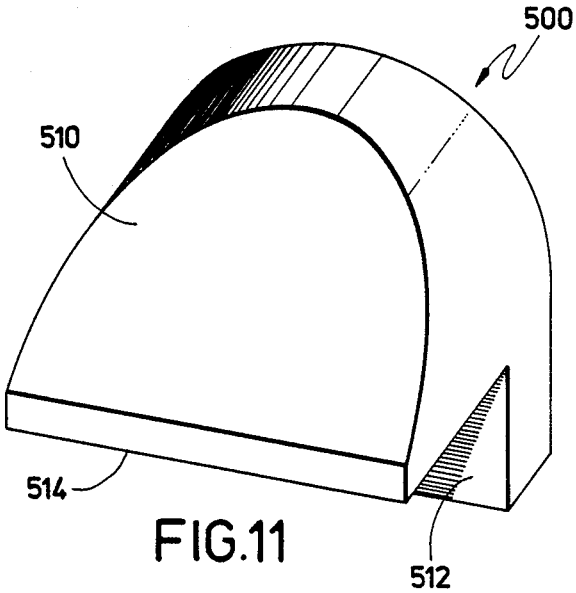
Figure 12:
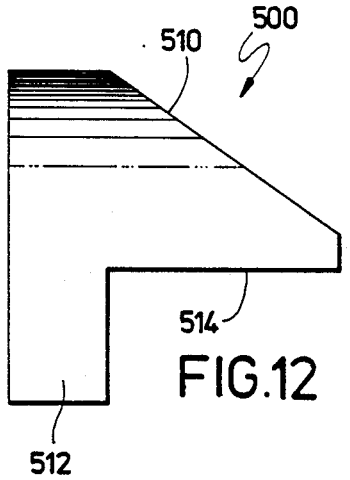
FIGS. 12 and 15 are side views of the headrests of FIGS. 11 and 14, respectively.
Figure 13:
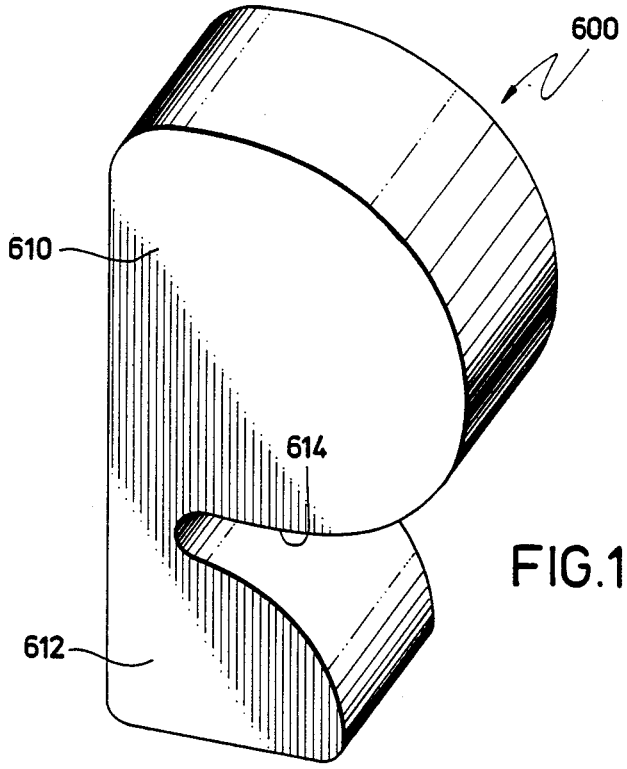
Figure 14:
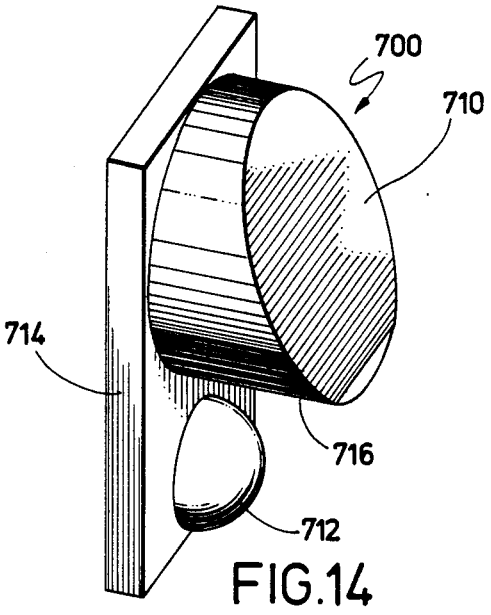
Figure 15:
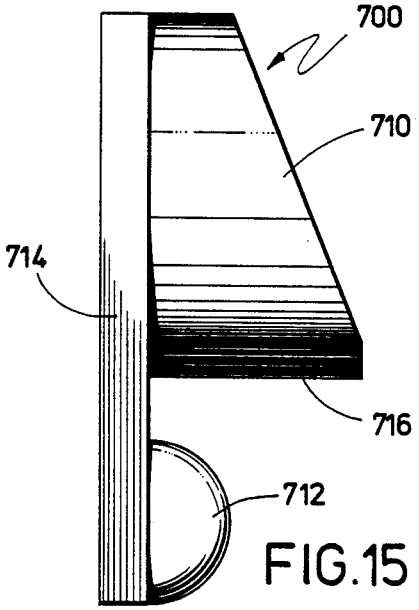

As shown in FIGS. 11, 12, 13, 14, and 15 of the drawings, exemplary headrests or headrest bodies 500, 600, and 700 having complex geometrical configurations are encompassed by the present invention. The headrest 500 includes an upper head supporting formation 510, a lower placement maintaining formation 512, and a horizontal support surface 514 (FIGS. 11 and 12). Similarly, the headrest 600 includes an upper head supporting formation 610, a lower placement maintaining formation 612, and a horizontal support surface 614 (FIG. 13). The headrest 700 includes an upper head supporting, cylindrical formation 710 and a lower placement maintaining, hemispherical formation 512 joined by a rectangular vertical section 714. A lower surface of the cylinder 710 forms a horizontal support surface 716. The headrests 500, 600, and 700 are formed, for example, by cutting, extruding, joining and/or molding one or more foam materials.

Thus, it will be appreciated that as a result of the present invention, a highly effective improved headrest is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

I claim:

1. A headrest for use with a seatback located adjacent a substantially vertical surface, comprising:

upper means for supporting the head of a user at a selected position above the seatback and cushioning the head of the user against direct impact with the vertical surface, lower means for maintaining the position of the upper means during use and providing for quick and easy placement and removal of said headrest with respect to said seatback, said upper and lower means each consisting essentially of a resilient foam body having a rounded edge truncated right triangle cross section.

2. The headrest of claim 1, wherein said upper and lower means form a single unitary body.

3. The headrest of claim 2, wherein said unitary body is covered with a material such as upholstery material.

4. A headrest for use with a seatback located adjacent a substantially vertical surface, comprising:

upper means for supporting the head of a user at a selected position above the seatback and cushioning the head of the user against direct impact with the vertical surface, lower means for maintaining the position of the upper means during use and providing for quick and easy placement and removal of said headrest with respect to said seatback, said lower means consisting essentially of a resilient foam body having a plurality of truncated right triangles in cross section.

5. The headrest of claim 4, wherein said upper and lower means form a single unitary body.

6. The headrest of claim 5, wherein said unitary body is covered with a material such as upholstery material.

7. A headrest for use with a seatback located adjacent a substantially vertical surface, comprising:

upper means for supporting the head of a user and cushioning the head of the user against direct impact with the vertical surface;

lower means for maintaining the position of the upper means during use and providing for quick and easy placement and removal of said headrest with respect to said seatback;

said lower means consisting essentially of a resilient foam body having a rectangular cross section said upper means consisting essentially of a resilient foam body having a truncated right triangle cross section and said upper and lower means forming a single unitary body.

8. The headrest of claim 7, wherein said unitary body is covered with a material such as upholstery material.

9. A headrest for use with a seatback located adjacent a substantially vertical surface, comprising:

upper means for cushioning the head of the user against direct impact with the vertical surface;

lower means for maintaining the position of the upper means during use and providing for quick and easy placement and removal of said headrest with respect to said seatback;

said lower means consisting essentially of a resilient foam body having a parallelogram cross section said upper means consisting essentially of a resilient foam body having a truncated right triangle cross section and said upper and lower means forming a single unitary body.

10. The headrest of claim 9, wherein said unitary body is covered with a material such as upholstery material.

* * * * *